United States Patent [19]

Levinson

[11] 4,103,431

[45] Aug. 1, 1978

[54] MICROWAVE DRYING

[76] Inventor: Melvin L. Levinson, 1 Meinzer St., Avenel, N.J. 07001

[21] Appl. No.: 713,235

[22] Filed: Aug. 10, 1976

Related U.S. Application Data

[63] Continuation-in-part of Ser. No. 572,385, Apr. 28, 1975, abandoned, which is a continuation-in-part of Ser. No. 325,330, Jan. 22, 1973, Pat. No. 3,881,027, Ser. No. 400,416, Sep. 24, 1973, Pat. No. 3,985,991, and Ser. No. 529,052, Dec. 3, 1974, Pat. No. 3,985,990.

[51] Int. Cl.[2] ..... F26B 3/28

[52] U.S. Cl. ..... 34/4; 34/1; 426/234; 426/243; 219/10.55 E

[58] Field of Search ..... 426/234, 243; 219/10.55 E; 34/4, 1

[56] References Cited

U.S. PATENT DOCUMENTS

| | | | |
|---|---|---|---|
| 2,600,566 | 6/1952 | Moffett, Jr. | 426/234 |
| 2,820,127 | 1/1958 | Argento et al. | 219/10.55 E |
| 2,879,367 | 3/1959 | Mc Lean | 426/234 |
| 3,410,116 | 11/1968 | Levinson | 219/10.55 E |
| 3,835,280 | 9/1974 | Gades et al. | 219/10.55 E |

OTHER PUBLICATIONS

Pp. 349–354 from the *Journal of Microwave Power,* Sep. 4, 1974, "Microwave Drying of Water Soaked Books".

*Primary Examiner*—John J. Camby

[57] ABSTRACT

The surface of an article to be dried, during a microwave exposure, is temporarily extended by enclosing said article within a microwave-permeable, vapor-resistant, heat-resistant, elastic or rigid enclosure which employs a water and/or vapor release means, and, during a microwave exposure, the vapor temperature of said heating article is monitored.

23 Claims, 3 Drawing Figures

MICROWAVE DRYING

CROSS REFERENCE TO RELATED APPLICATIONS

Continuation-in-part of Ser. No. 572,385, Apr. 28, 1975, now abandoned, which is a continuation-in-part of Ser. No. 325,330, Jan. 22, 1973, now U.S. Pat. No. 3,881,027, Ser. No. 400,416, Sept. 24, 1973, now U.S. Pat. No. 3,985,991, and Ser. No. 529,052, Dec. 3, 1974, now U.S. Pat. No. 3,985,990.

BACKGROUND OF THE INVENTION

1. Field of the Invention

Methods and apparatus for drying articles, as water soaked books, bread for poultry stuffing, precooked french fried frozen convenience potatoes, wet clay, etc., in a microwave oven are described.

2. Description of Prior Art

Microwave ovens for heating, cooking and drying are daily becoming more popular. Microwave radiation can, instantaneously, deep heat a microwave-lossy, microwave-permeable article where, in contrast, infrared radiation surface heats. Microwave deep heating can result in an article's core heating faster than said article's surface. Since microwave ovens operate with cold walls, the surface of an article loses heat to said cool oven walls and to cool, oven circulating air while its core's heat builds up. In drying, core heating results in an internal vapor pressure build up within said core. This core vapor pressure mechanically drives loose water before it to the surface of the article until at the surface of said article said vapor's pressure releases and said vapor forms a vapor blanket over said surface. In prior art, to speed drying, fans are employed to mechanically break up said vapor blanket and evaporate mechanically released water.

Methods and apparatus for dealing with by-product water and recycling the latent heat of vaporization are described in my U.S. Pat. Nos. 3,985,990 and 3,985,991. This invention does not require a microwave-reflective, heat-conductive container or the microwave lossy auxillary heating elements of my previous inventions, but concerns apparatus and methods designed to take advantage of microwave engendered core heating.

SUMMARY OF THE INVENTION

It is an object of this invention to describe apparatus and methods for controlled even drying and bone drying of an article.

It is a further object of this invention to describe apparatus and methods for (1) reconstituting frozen precooked french fried potatoes and (2) "baking" raw frozen baking potatoes.

It is an object of this invention to describe apparatus and methods for drying and firing wet clay.

This invention describes encasing an article within a microwave-permeable, partial-vapor-barrier, heat-insulating, elastic or rigid enclosure which can be liquid-absorptive, then exposing said article and enclosure to microwave radiation while controlling the microwave heating rate and vapor release rate of said article while said article is drying.

DESCRIPTION OF THE PREFERRED EMBODIMENTS

Figure 1:
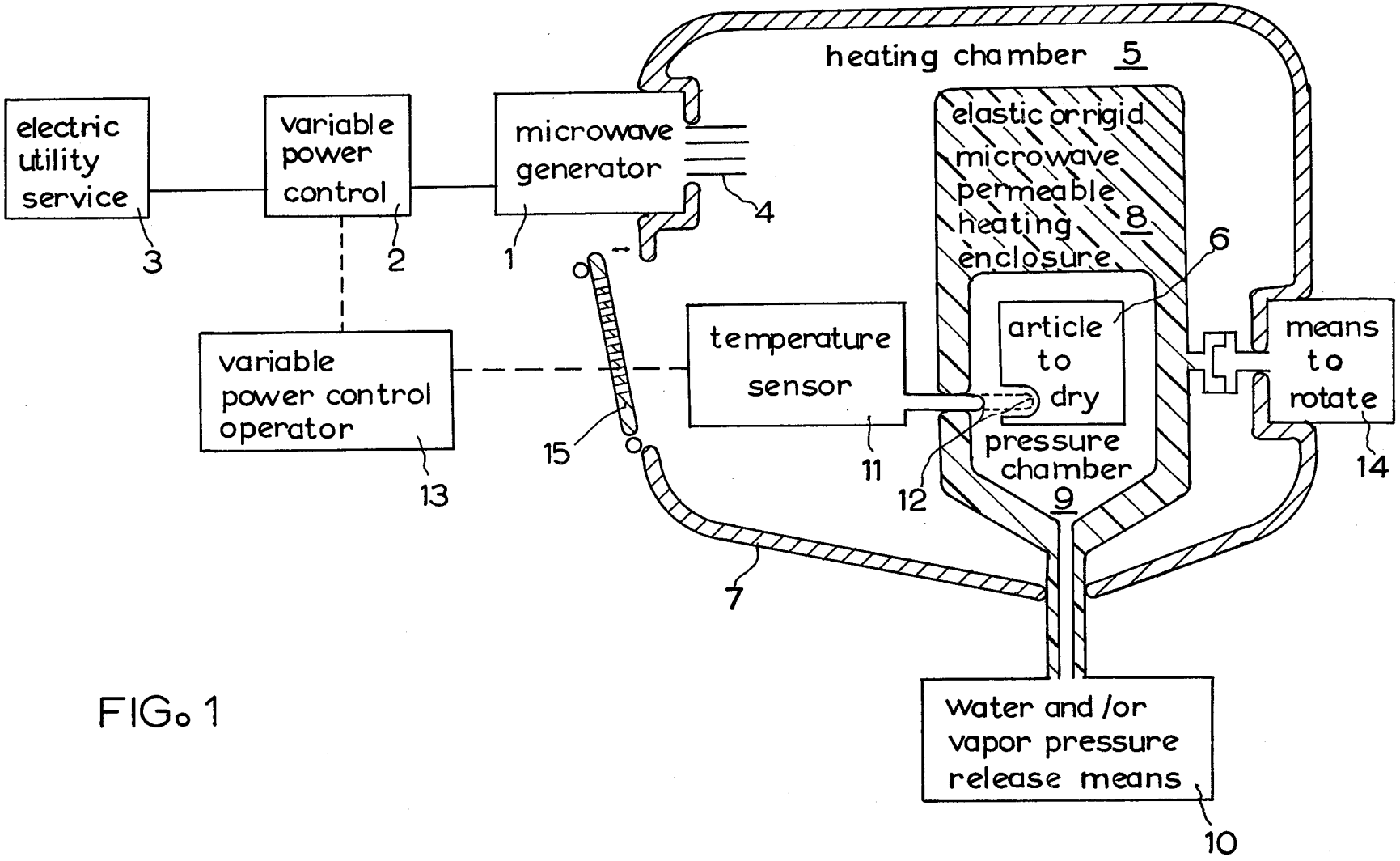
FIG. 1 illustrates the elements and methods of this invention and their interrelationship.

In FIG. 1, a microwave generator 1 whose power output is under the control of a variable power control 2, is powered from an electric utility service 3. A description of suitable variable power supply circuits may be found in my U.S. Pat. Nos. 3,732,504 (where is described the series circuit of an AC power source, a variable inductance and the primary of a high voltage transformer powering a heating magnetron), 3,760,291 (where is described the series circuit of a power source, a variable resistance and a heating magnetron), 3,792,369 (where is described the series circuit of an AC power source, a variable reactance and a heating magnetron) and 3,876,956 (where is described the series circuit of an AC power source, a variable resistance and a heating magnetron in combination with a fixed reactance-diode circuit where, at low or no resistance, the size of said fixed reactance is chosen to regulate said magnetron over normal variations in the voltage of said power source). Microwave energy rays 4 from microwave generator 1 enter through an opening in walls 7 of microwave oven chamber 5 and therein irradiate an article 6 which they are required to dry — all by apparatus and in a manner well known to the microwave oven art. Article 6 is disposed within a microwave-permeable, heating enclosure 8 within chamber 5.

Heating enclosure 8, constructed so that it will permit a build up of vapor pressure in its pressure chamber 9, is equipped with a temperature sensor 11 to permit temperature monitoring of the temperature of chamber 9 from outside microwave oven walls 7. A water and/or vapor release means 10 is combined with pressure chamber 9 to release water and/or vapor to either chamber 5 or a location outside walls 7.

Microwave-permeable heating enclosure 8 can be made of a brittle, vapor and water impermeable material, as glass, and be equipped with a pressure release means 10. In such case, pressure release means 10 can be a small opening through enclosure 8 which, if desired, can pass through chamber 5 and oven walls 7. I prefer that the water and/or vapor pressure release means be inherent in the material of which enclosure 8 is made. I prefer a semi-rigid, porous material, as fibre paper (ex. as manufactured by Keyes Fibre Company for their Sho-Pak trays and Chi-Net plates) or open pore polyeurethane plastic foam. Said fibre paper enclosure can be disposable and said plastic foam enclosure washable and reusable. Glass, paper or plastic enclosure 8 must be of sufficient thickness and strength to offer a positive resistance to the free release of vapor pressure from chamber 9 and so structured so that, in operation, enclosure 8 permits a vapor pressure build up in chamber 9. Paper and plastic do not require extra safety valves backing up release means 10 that are obvious for glass. Said Keyes Fibre Company's paper is such that, without soaking through, water can be contained and boiled therein while steam passes therethrough and oil and fat is absorbed thereby.

Temperature sensor 11 can be an ordinary metal thermometer whose stem is designed for use in a microwave oven and whose temperature read out can be viewed from outside the microwave oven. This is discussed and illustrated in my U.S. Pat. No. 3,881,027 where is claimed monitoring the temperature of a baking chamber heated by a microwave lossy material and where a Weston Model No. 2261 or 2292 thermometer is arranged to be viewed through a window in a microwave oven so that the temperature of said baking chamber can be monitored.

The fastest speed of safe drying is determined empirically for different articles and for different shapes of the same article. For example, the rate at which a wet clay can give up its water (i.e. dry) depends upon its composition, porosity and wetness. When in doubt as to what is the fastest speed, or when speed is not a factor, temperatures below 212° F (i.e. boiling) are proper. But, for speed, as most things, wet or dry, have inherent mechanical strength, operating temperatures above 212° F are to be expected, for example a core temperature of 220°–250° F with a chamber 9 temperature of circa 212° F. When the temperature of chamber 9 is 200° F, the internal temperature of article 6 is always higher (i.e. core heating effect) as article 6 is both the heat converter and so heat generator of my system. An expanding head of steam, which by design and plan is initiated at the core of article 6, mechanically drives loosely held water from article 6. Note that in a conventional gas or electric drying oven, since the heat is applied from the surface, (1) the ability to mechanically remove loose water by core heating is not present and (2) the surface of certain articles, as drying clay, crust and, their surface shrinking onto a still cool, wet expanding core, surface crack. With microwave core heating, the core dries and shrinks before or with the surface minimizing surface damage.

In operation, if spot and selective heating of article 6 is undesirable, starting from low, the variable power output of microwave generator 1 is raised gradually by variable control operator 13 which can be a manual operation by the operator of the process observing temperature sensor 11 through a window on door 15. Initially, minor variations of variable power control 2 may be required to maintain the temperature of chamber 9 at a first predetermined temperature. When that setting of the variable power control is arrived at which can maintain said first predetermined temperature, the variable power control is no longer varied and the temperature is monitored until said temperature starts to rise sharply signaling that bulk drying is complete. When the temperature rises to a second preselected point, the exposure of article 6 to microwave energy is terminated. Said second preselected temperature must be below the ignition or scorching temperature (considering core heating) of either article 6 or enclosure 8. Then depending on the results required, enclosure 8 with article 6 is either allowed to cool within the microwave oven or removed from the microwave oven and allowed to cool at a remote location. Many articles can be dried simultaneously in a single enclosure or a series of enclosures used to dry a series of articles on a microwave oven conveyor belt. Hot enclosure 8 may be opened immediately and hot article 6 removed and used hot or article 6 can be cooled outside of enclosure 8 for subsequent use. Conversely, if article 6 is very wet or large in relationship to the maximum oven power and/or some spot and selective heating of article 6 is not objectionable, starting from the maximum power end of variable power control 2, microwave generator 1's power output is lowered as the core temperature of article 6 rises to said first predetermined temperature.

During bulk drying and before the second predetermined temperature is reached, the power output of the microwave generator can be increased to match the increasing strength of most drying articles. The increase in power output to complement the increase in strength curve is best determined empirically to discover that program that provides a safety margin above which will damage the article.

When enclosure 8 is made out of fibre paper or open pore plastic foam, enclosure 8 can be considered as an extension of wet article 6 (whether or not divided physically from article 6 by an interface of air insulation) with microwave energy drying the core (article 6) of the article-enclosure combination. Whether or not enclosure 8, per se, (while acting as a temporary extension of article 6) is left evenly dry is not important. What is important is that the core (article 6) of said combination reaches a much higher temperature and vapor pressure than the surface (enclosure 8) of said combination, and that, due to the heat-insulating properties of enclosure 8, said high temperature and high vapor pressure evenly dries article 6. This invention is useful for drying articles which articles, if dried without being temporarily combined with an enclosure, would not surface dry easily or, when said article's surface was completely dry, would be subject to core damage from overheating.

The water absorptive properties of fibre paper and open pore plastic foam can be used to advantage to blot and so mechanically carry off surface water accumulating during exposure of article 6 to microwave energy. To blot water, Keyes Fibre Company's Duo-Pak paper or other more water absorptive paper should be employed. To provide means for enclosure 8 to conform to and intimately contact the surface of the varying shapes of article 6, enclosure 8 can be made from a solid piece of open-pore polyurethane plastic foam or similar high-temperature, open-pore plastic foams into which a knife cut forms a collapsed pocket (i.e. chamber 9). Said collapsed pocket is temporarily forced open and article 6 is placed therein. On closing, the elastic action of the polyurethane foam forces said foam into intimate contact with the surface of the article to be dried. The opening left in said plastic foam enclosure is easily sealed by inserting an insert of the same plastic foam material as that of the enclosure therein. For uniform drying it is preferred that the enclosure be of homogeneous material. Said open pore plastic foam slit enclosure can be employed to dry such diverse items as baked potatoes from raw (i.e. incomplete, even drying), water soaked books (i.e. bone drying) and innovative products, as a three-dimensionally-toasted dinner roll (i.e. drying continued past bone drying to browning). Temperature sensor 11 is required with said foam slit enclosure, and sensor 11's sensing element is best placed between the pages of said book or within the mass of said potato. For specific items, common precautions are required. For instance, in drying water soaked books, if the coloring of said book is water soluble and runs, said cover must be removed before said book's pages are placed into said enclosure. If it is desired to bake a raw frozen potato, first place potato into enclosure without temperature sensor 11 and expose to microwave radiation until said potato defrosts and sensor 11 can be readily inserted. Bread and rolls can be dried to make dried bread stuffing and the like. But, if the drying of said bread and rolls is continued to three-dimensional-toasting, a product similar to melba toast is produced and temperature sensor 11 takes on a further function of sensing when browning is completed. Before burning can occur, microwave exposure is terminated. In all cases, care must be exercised that the plastic foam is a plastic that can withstand the steam temperatures anticipated.

Precooked-in-oil, frozen convenience french fried potatoes can be defrosed, heated and dried to taste in a rigid fibre paper enclosure. The results are surprisingly similar to those expected from the same potatoes fried in a conventional deep fat fryer. The enclosure can double as a shipping, heating and serving container with the added advantages of (1) said fibre container trapping oil splatter during heating, (2) said paper absorbing some of the oil draining from potatoes during heating for a more appetizing product, (3) no scalding hot cooking oil to handle, cool and dispose of, (4) no pot holders required as water evaporates readily from paper enclosure's outer surface cooling it so that it is not dangerous to hold and (5) no bothersome oily metal pot to scour as paper is disposable.

Figure 2:
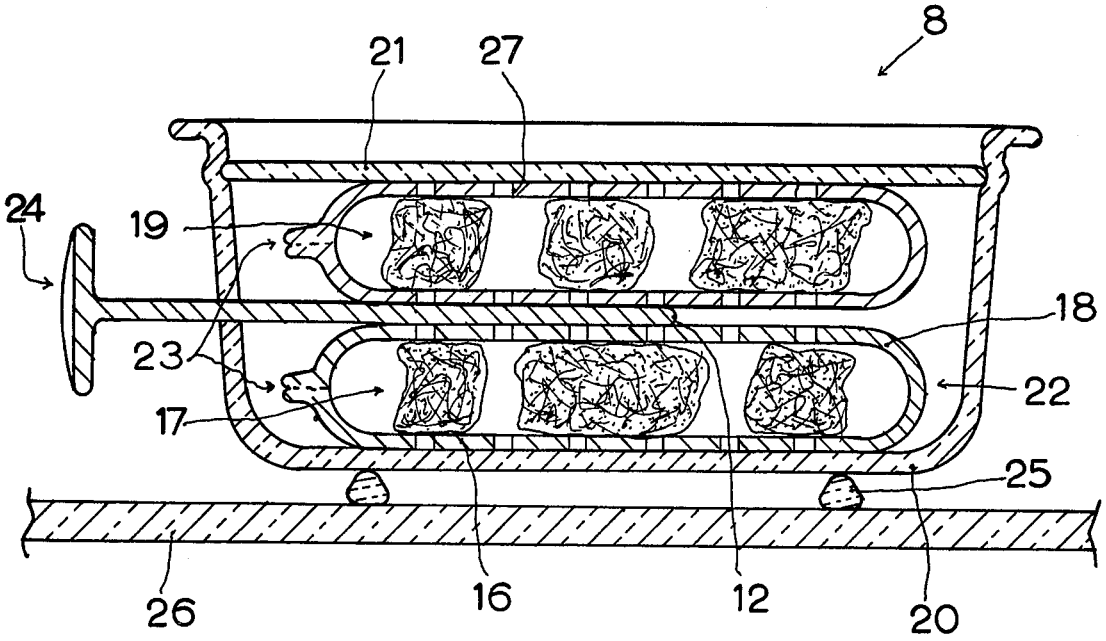
FIG. 2 illustrates one embodiment of this invention for reconstituting precooked, frozen, convenience, french fried potatoes.

In FIG. 2, to keep during defrosting and heating a large multilayer serving of precooked-in-oil, frozen, convenience french fried potatoes from sticking together in a three dimensional mass within enclosure 8 (where enclosure 8 is illustrated as a fibre paper tray 20 and mating cover 21) place a plastic film 16 on the bottom of tray 20, on which place a single layer of potato sections 17, cover with a second plastic film 18 and thereon place a second single layer of potato sections 19 covered by a third plastic film 27. Additional layers of potatoes and plastic film (not shown) can be added as desired. A temperature sensor, thermometor 24's sensor element 12, is preferrably placed to measure the core temperature of the pile of potato sections. High temperature plastic film (a plastic film suitable for baking and browning in gas and electric ovens), as Nylon '6' and polyester is required. Plastic films 16, 18 and 27 may be perforated so that advantageously a portion of the fat employed in precooking can migrate, on heating, to paper container 20 and there be absorbed. This means that after removing the heated french fries, the separate step, associated with removing french fries from hot fat in gas and electric heating, of draining and blotting excess fat into a paper towel, is eliminated.

In FIG. 2, in a typical operation, a layer 17 of pecooked-in-oil, convenience french fries is packaged in a perforated, high-temperature, plastic film bag 22 which is subsequently, loosely, imperfectly heat sealed 23. This is repeated until a desired quantity of bags 22 are prepared (two illustrated) and disposed in layers on the bottom of paper container 20. A mating cover 21 is affixed to container 20. The sensor element 12 of metal thermometer 24 is inserted through paper container 20's side wall and preferrably embedded both deep into the mass of potatoes and between layers 17 and 19. Enclosure 8 is placed within a microwave oven on stands 25 or directly on oven shelf 26. Stands 25 permit the free release of hot vapor from the bottom of enclosure 8 and prevent the trapping of water as hot vapor condenses between the bottom of container 20 and cool oven shelf 26. Enclosure 8 is exposed to microwave radiation and the power output of the microwave generator is varied until thermometer 24 holds at a first predetermined temperature, for example, in a circa 600 watt domestic microwave oven, a temperature of circa 250° F. Said exposure is terminated after thermometer 24 reaches a second predetermined temperature, for example circa 300° F, thereupon one may wish to let the measured temperature drop to below 212° F before opening enclosure 8. Temperatures are determined empirically taking into account freezer temperature, type of potato, cut of potato as well as individual preference as to the eveness of browning and drying desired. Obviously, after a few trials, if the size of the portion, freezer temperature and other such variables are held constant, thermometer 24 is no longer required and just microwave power level and time need be considered.

Alternately, to keep the defrosting, heating potato sections from sticking together (without plastic film 16, 18 and 27 alternating between layers) heat in steps and at each step sharply tap and/or shake the enclosure to seperate the potato sections. Alternately, electromechanical means 14 can be employed to rotate, during heating, enclosure 8 and so continuously tumble and seperate the potato sections in the manner of enclosure 8 attached to a rotesserie. Grain and other such loose articles can benefit from mechanically stirring during a microwave exposure. My U.S. Pat. No. 3,410,116 describes and illustrates a microwave rotary tumble apparatus which could be improved as here taught. Mechanical tumbling permits higher heat levels and causes surface water to be shaken off or blotted off onto the liquid absorptive enclosure more uniformily.

If one desires a novel, tasty product, a "french fried potato-potato chip" (a large french fried potato section dried to the dryness of a potato chip), than thermometer 24 must be carefully monitored for at this product's second predetermined temperature it is easy to exceed the required temperature and burn (blacken) said product. If undesirable burning (spot heating of article 6) occurs, next time operate at a lower power level. Burning can occur at the tip of thermometer 24 for as drying progresses the natural build up of an electrical discharge potential at the end of electrical conducting sensor element 12 is no longer highly dampened by saturated water vapor and corona and arcing discharges can occur therefrom. If undesirable burning occurs at sensor element 12, operate at a lower first predetermined power level. As the power level is lowered a power level is reached where the heat energy released by a corona or arcing discharge is less than that amount of heat that can be dissipated by normal conduction and convection heat transfer within article 6. In which case, the energy added being equal to the energy dissipated, heat can not build to a level high enough to spot burn. It should be noted that the converse, promoting corona and arcing discharges, which can result in burning temperatures at the end of a temperature sensor, need not be considered undesirable if the article, as drying clay, can withstand such temperatures. In this case metal sensor element 12 can serve to concentrate burning energy at a planned location within a high temperature resilient drying article.

Figure 3:
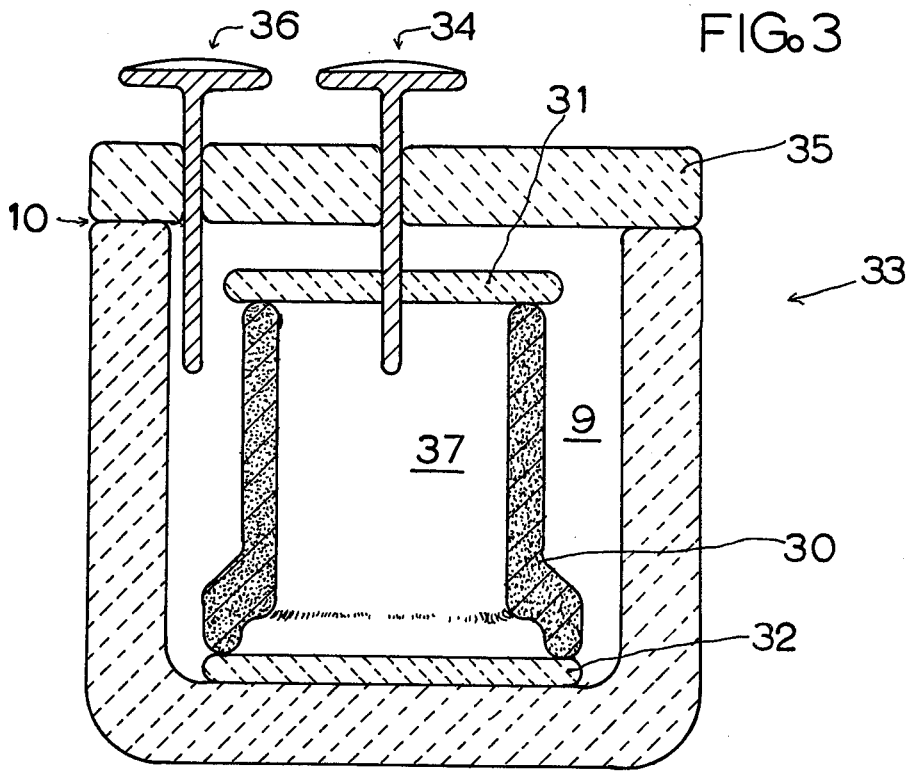
FIG. 3 illustrates another embodiment of this invention for drying wet clay.

FIG. 3 is an example of an apparatus to dry a wet clay pipe 30 before pipe 30 is fired. Wet clay pipe 30 is shown within a water-porous, non-lossy, heat-insulating firebrick (example, GR-25 insulating firebrick manufactured by General Refractories Company) enclosure 33. Pipe 30 is illustrated standing on end and closed at both ends by fired ceramic plates 31 and 32. Plates 31 and 32 are present to partially impede the free release of hot vapor out of the otherwise open ends of pipe 30. A thermometer 34 is inserted through both enclosure 33's cover 34 and plug 31 so that its sensor element reads the temperature of water vapor released into pipe 30's core chamber 37. Enclosure 33 is placed in a microwave oven so that the temperature read out of thermometer 34 can be monitored from without said microwave oven. Enclosure 33 is exposed to microwave radiation and the power of said microwave oven is adjusted until the temperature of core chamber 37 holds at a preselected first temperature. Said exposure is continued until said thermometer 34 indicates that core chamber 37 has reached a second preselected temperature. Alternately, when speed or extra precision is required a second thermometer 36 can be employed with thermometer 34 to monitor the temperature of partial pressure chamber 9 as well as core chamber 37. Thermometer 34 can be employed without thermometer 36 and is then used to monitor the drying rate selected (e.g. the first predetermined temperature which is the vapor temperature which results from drying an article at a preselected power level multiplied by the type of material of enclosure 33 added to the vapor seal and weight of cover 35). Drying is completed when thermometer 34 and/or 36 indicates that no free water can exist at a second preselected temperature, for example 350° F on thermometer 36 when enclosure 33 can only maintain circa 220° F saturated vapor pressure at the preselected power level employed.

Enclosure 33 need not be made of a water or vapor porous material. I have employed foamed fused silica insulating firebrick manufactured by Carborundum Company. This foamed material acts at 2,000° F as a Styrofoam heat insulating picnic hamper would act at 150° F.

After the drying phase is completed, thermometer 34 and/or 36 can be removed and the variable power control varied to a higher power whereupon enclosure 33 becomes a ceramic firing kiln. My U.S. Pat. Nos. 3,469,053, 3,589,657 and 3,585,258 describe firing ceramic in a microwave kiln. The microwave lossy arcing elements of said prior patents may be added after drying or located on, in or about pipe 30 during the drying cycle. Saturated water vapor, released from drying pipe 30, dampens electric arcs and it is not until clay pipe 30 dries and at higher microwave power levels that microwave arcing heating elements are useful to fire pipe 30.

While (1) turning on, (2) adjusting microwave power, (3) observing thermometer readings and (4) turning off power at a second temperature have been described as a manual operation, it is expected that others will wish to automate this operation without the exercise of invention. Simple modifications of existing temperature sensing circuits are possible.

There are four well known ways of transferring heat energy: (1) conduction, (2) convection, (3) radiation and (4) water to water vapor systems where water is evaporated and in so doing absorbs heat and the resultant vapors carry away this heat (e.g. the latent heat of evaporation). Enclosure 8 of this invention is designed and fabricated to limit heat losses from article 6 through (1) conduction, (2) convection and (3) radiation and so force the heat energy that microwave rays 4 add to article 6 to dissipate predominately through water to water vapor heat losses. Hot confined vapor, before it can escape chamber 9, under pressure seeks out any structure or water within chamber 9 below its dew point and condenses thereon and so raises said material's temperature. This hot vapor, under pressure, transferring heat throughout chamber 9 severly limits the problem of spot and selective heating that has plagued microwave oven operation from its inception. What spot and selective heating problem that may remain is effectively controlled by lowering the output of microwave generator 1 by variable power control 2 and by improvements in the construction and fabrication of enclosure 8 to limit conduction, convection and radiant heat losses therefrom. After all its water is evaporated, article 6 is no longer able to cool itself through evaporating water from its surface. Hence, article 6's temperature rises rapidly to said second preselected temperature for, as stated, article 6 is blocked, within the bounds of a drying oven, from losing heat by conduction, convection and radiation.

Although this invention has been described with a certain degree of particularity, it is understood that the present disclosure has been made only by way of example and that numerous changes in the details and construction and in the combination and arrangement of parts and in the methods described may be resorted to without departing from the spirit and scope of the invention.

I claim:

1. A method of uniformly drying a microwave-lossy article within the oven cavity of a microwave oven equipped with a variable power control the steps which include:

completely enclosing said article in a chamber defined by a microwave-permeable, heat-insulating enclosure where said enclosure is designed to impede the release of vapor from said chamber, exposing said article to microwave energy and adjusting said variable power control while monitoring the vapor temperature within said chamber until said vapor temperature holds at a first predetermined temperature, and, at said holding power level, continuing said exposure until said temperature rises to a second predetermined temperature.

2. In a method of drying, according to claim 1, further including:

releasing, from said chamber, liquid condensed from vapor and liquid evolved from said microwave lossy article during said microwave exposure.

3. In a method of drying, according to claim 1, which includes:

where said first predetermined temperature is a chamber vapor temperature below the boiling temperature of the liquid component of said drying article.

4. In a method of drying, according to claim 1, which includes:

where said second predetermined temperature is at the browning temperature of said article and below the burning temperature of said article.

5. In a method of drying, according to claim 1, further including:

tumbling said enclosure to tumble said article within said chamber.

6. In a method of drying, according to claim 1, which includes:

during said bulk drying, before said second predetermined temperature, as said article dries and increases in strength, increasing the power output of said variable power control to match said increase in strength.

7. In a method of drying, according to claim 1, which includes:

where said monitoring the vapor temperature within said chamber is accomplished by placing a temperature sensor within the configuration of said article.

8. In a method of drying, according to claim 7, which includes:

where said second predetermined temperature is higher than 280° F.

9. In a microwave oven comprising an enclosure for receiving a microwave-lossy wet article and means for emitting microwave energy to said article, for use in said oven, an improved apparatus for processing said article therein, and, to permit the insertion and removal of said article, access means located both in said enclosure and in said apparatus, said improved apparatus comprising in combination:

a microwave-permeable, heat-insulating, elastic, water-absorptive enclosure which defines a drying chamber designed to receive said article and which is designed to impede vapor release from said chamber, and where said drying chamber is designed (1) to be smaller in physical dimension than said article and can only receive said article if the walls of said elastic enclosure are stressed apart and (2) when said article is in said enclosure said walls of said elastic enclosure, attempting to return to their unstressed condition, contract and conform to the outer surface of said article exerting pressure thereon.

10. Apparatus for drying, according to claim 9 which includes:

where said enclosure is made from open-pore, plastic foam.

11. In a microwave oven combination, according to claim 9, which includes:

where said article is a water soaked book.

12. In a method of drying a lossy wet article in a microwave oven the steps which include:

enclosing said article in a chamber constructed of a material which, at said article's drying temperature, is designed (1) to block conductive, convective and radiant heat loss from said article and (2) to confine about said article a preselected positive vapor pressure, exposing said wet article to microwave energy until said microwave energy is converted to heat energy within said article and said heat energy vaporizes the liquid of said wet article so that (1) said heat energy, as the latent heat of vaporization, at said preselected positive vapor pressure, will overlay said article and (2) at vapor pressure levels higher than said preselected vapor pressure said vaporized liquid can escape said chamber, and isolating the outside surface of said chamber from direct contact with cool, vapor-condensing oven surfaces, to prevent the entrapment of liquid, from hot vapor condensing on said cool surface, between said outside surface and said cool oven surface.

13. In a method for reconstituting frozen, precooked, french fried potatoes in a microwave oven, the steps which include:

placing at least two single layers of said potatoes divided by a sheet of high-temperature plastic-film in a chamber defined by a microwave-permeable, heat-insulating enclosure where said enclosure is designed to confine within said chamber a positive vapor pressure, placing said enclosure within said microwave oven, and exposing said potatoes in said chamber to microwave energy until confined vapor, released by said potatoes, measures a temperature higher than 250° F.

14. A process for uniformily drying a microwave-lossy, wet article by enclosing said article within a liquid-absorptive, microwave-non-lossy enclosure and tumbling said enclosure, to tumble said article within said enclosure, while subjecting said enclosure and said article to microwave radiation and while confining, within said enclosure and about said article, a predetermined positive vapor pressure.

15. In a microwave oven comprising an enclosure for receiving a microwave-lossy, wet article and means for emitting microwave energy to said article, for use in said oven, an improved container for processing said article therein, and to permit the insertion and removal of said article, access means located both in said enclosure and in said container, said improved container comprising in combination:

a water and fat absorptive, heat-insulating outer container designed to confine a positive vapor pressure therein, a high-temperature, plastic-film inner container disposed within said outer container where said inner container is designed to contain said article therein and where said inner container is perforated to permit the free escape of liquid, vapor and cooking fat therefrom.

16. In a microwave oven combination, according to claim 15, which includes where more than one plastic-film inner container is employed within said outer container.

17. In a microwave oven combination, according to claim 15, which includes:

means to stand off said outer container from physical contact with cool parts of said microwave enclosure to limit liquid, condensed from vapor on said cool parts, from contacting said outer container.

18. A method of drying a microwave-lossy, wet, hollow article by exposing said article to microwave energy the steps of which include:

covering said hollow in said article to confine within said hollow a positive vapor pressure during said exposure to microwave energy, exposing said article to microwave energy, monitoring the temperature of said positive vapor pressure released during said exposure to microwave energy by said article and confined within said hollow, and terminating said exposure to microwave energy when said positive vapor pressure's temperature reaches a predetermined temperature.

19. A method of drying a microwave lossy wet article by exposing said article to microwave energy the steps of which include:

exposing said article to microwave energy, confining about said article a preselected positive vapor pressure, and terminating said exposure when said article is dried by reaching a temperature higher than 249° F.

20. A process, according to claim 19, where said article is a bread product processed to become dried bread stuffing.

21. A process for drying a wet article which comprises:

stressing apart an elastic, liquid absorptive material by inserting said wet article in an opening within said material, and exposing said article, confined by said elastic material, to microwave energy until said article is dried.

22. In a process, according to claim 21, where said article is a water soaked book.

23. In a method for uniformily drying a microwave-lossy, wet article the steps which include:

enclosing said article within a liquid-absorptive microwave-permeable, closed enclosure, tumbling said enclosure with said article therein to tumble said wet article against said liquid-absorptive enclosure thereby blotting said wet article, exposing said enclosure with said article therein to microwave radiation from a microwave generator, confining within said enclosure and about said article a positive pressure of vapor released by said article during said exposure to microwave radiation, monitoring the temperature of said released vapor, adjusting the power level of said microwave generator until the temperature of said vapor holds at a first predetermined temperature, and continuing said exposure until the temperature of said vapor rises to a second predetermined temperature.

* * * * *